US009115957B1

(12) United States Patent
Winker

(10) Patent No.: US 9,115,957 B1
(45) Date of Patent: Aug. 25, 2015

(54) ALIGNMENT TOOL

(71) Applicant: Bruce Winker, Ventura, CA (US)

(72) Inventor: Bruce Winker, Ventura, CA (US)

( * ) Notice: Subject to any disclaimer, the term of this patent is extended or adjusted under 35 U.S.C. 154(b) by 0 days.

(21) Appl. No.: 14/176,726

(22) Filed: Feb. 10, 2014

Related U.S. Application Data

(60) Provisional application No. 61/762,441, filed on Feb. 8, 2013.

(51) Int. Cl.
*F41G 3/32* (2006.01)
*F41G 1/54* (2006.01)

(52) U.S. Cl.
CPC ..... *F41G 3/323* (2013.01); *F41G 1/545* (2013.01)

(58) Field of Classification Search
CPC ..... F41G 1/38; F41G 1/44; F41G 1/54; F41G 1/545; F41G 3/323; F41G 3/326
USPC ..... 42/90, 111, 113, 114, 115, 120, 124, 42/125, 126, 134, 135
See application file for complete search history.

(56) References Cited

U.S. PATENT DOCUMENTS 3,908,282 A * 9/1975 Steffan ..... 42/121
5,499,455 A * 3/1996 Palmer ..... 42/120
5,878,504 A * 3/1999 Harms ..... 42/120
6,954,174 B2 * 10/2005 Isaji et al. ..... 342/173
8,561,341 B1 * 10/2013 Dihlmann ..... 42/126

* cited by examiner

*Primary Examiner* — Samir Abdosh
*Assistant Examiner* — John D Cooper
(74) *Attorney, Agent, or Firm* — Sandy Lipkin

(57) ABSTRACT

An improved alignment device and method of use thereof that provides a simple, inexpensive and accurate leveling device that can be used by non-technical people to align a rifle scope to the bore of the rifle and set the vertical crosshair or turret axis plumb to the Earth. The device and method allows the rifle scope to be quickly, conveniently and accurately aligned such that the vertical reticle axis or elevation turret axis is projected through the center of the rifle bore. The device and method can be used to level or plumb a flat surface on the scope by first locating an edge of the device parallel to a flat surface on the rifle scope. The device has a low center of gravity that allows the device to stand inverted, resting on a flat horizontal surface.

19 Claims, 4 Drawing Sheets

ALIGNMENT TOOL

REFERENCE TO PRIOR APPLICATION

This application claims priority of the provisional patent application 61/762,441, filed Feb. 8, 2013 entitled ALIGNMENT TOOL by Bruce Winker.

BACKGROUND OF THE INVENTION

1. Field of the Invention

The present invention relates to an apparatus and method for aligning a rifle scope to a rifle, and more particularly toward an apparatus and method in which either the reticle or reticle adjustment axis of the rifle scope can be quickly and accurately aligned to the bore of the rifle.

2. Description of the Prior Art

A rifle scope operates by superimposing an aiming reference mark on an image of the target. The aiming reference mark may be a reticle crosshair (intersection of two orthogonal straight lines), a "dot" or other reference mark either printed on glass or suspended on wires. The aiming reference mark may also be illuminated for use in low ambient light, or it may be formed by emission from a point source of light such as a light emitting diode, optical fiber, or illuminated pinhole. For purposes of this discussion, the aiming reference mark will be referred to as the crosshair. A line that passes through the center of the Earth is referred to as being plumb or vertical, and a line or plane that is orthogonal to a plumb line is referred to as horizontal or level. Two adjacent surfaces that are oriented at 90 degrees +/−1 degree with respect to each other are referred to as being square.

In rifle scopes the crosshair is located at the focus of the objective lens, and therefore the crosshair appears superimposed over the image of the target. The optical axis formed by the crosshair and the center of the objective lens is called the crosshair axis. The lateral position of the crosshair is controlled by use of a micrometer adjustment mechanism. By rotating two micrometers, one controlling the elevation crosshair position, and the other controlling the windage crosshair position, the crosshair axis can be adjusted as needed or desired. These two micrometer adjustment mechanisms move the reticle along axes that are orthogonal to the axis of the rifle scope tube or optical axis, and that are orthogonal to each other. The rifle is typically held such that the elevation turret axis is oriented in approximately the vertical direction and the windage turret axis is oriented in approximately the horizontal direction. The micrometer adjustment mechanism is often called a turret and the part of the turret that is manipulated by the user is often called the turret knob.

Rifle scopes are typically secured to rifles by use of rings that are split in half horizontally, creating a saddle that mounts to the rifle and a clamp that secures the scope tube to the saddle. Alternatively, the rings may be split vertically, creating two halves that clamp to a rail mounted on the rifle, while also clamping around the rifle scope tube. Typically, machine screws are used to secure one half of the ring to the other, clamping the scope tube between the two halves and thereby preventing movement of the scope due to recoil of the rifle or other disturbance. The rifle scope is typically mounted above the rifle bore. The crosshair axis is not parallel to the rifle bore axis, but rather it crosses the bore axis at a distance from the rifle of typically 50-200 yards, as determined by the person setting up the rifle.

The rifle is aimed by moving the rifle while looking at the target through the rifle scope. The direction of the rifle bore is moved until the crosshair coincides with the desired point of impact of the bullet fired from the rifle.

Typically, before the scope is secured in the rings, it is first aligned to the rifle by making a flat reference surface of the scope parallel to a corresponding flat reference surface on the rifle, usually a surface on the rifle receiver. Then the crosshair axis is adjusted to coincide with the point of impact of bullets at a specific range, say 100 yards. This process of live fire crosshair alignment is called "zeroing" the rifle.

To aim at targets at a different range than that at which the rifle was zeroed, the crosshair is raised or lowered by rotating the elevation turret knob to compensate for the effect of gravity on the bullet during flight, which is called bullet drop. The position of the crosshair may also be moved by rotating the windage turret knob to compensate for the effect of crosswind on the bullet trajectory.

Two types of aiming error can result when the rifle is zeroed at one range and then the reticle is adjusted to fire at a target at a much different range. First, if the elevation micrometer axis is not parallel to the direction of gravity, the movement of the crosshair will not be aligned with the direction of bullet drop. This aiming error is typically referred to as a canting error due to the rifle being rotated or "canted" left or right about the bore axis. A spirit level may be attached to the rifle or rifle scope to aid in determining a plumb orientation of the elevation turret axis. Alternatively, the reticle may have reference marks along a vertical line forming the crosshair. The rifle is raised so that one of these marks, corresponding to the target range, is superimposed over the target. In this case, a canting error may occur if the vertical line forming the crosshair is not parallel to the direction of gravity.

A carpenter's level, plumb bob or other leveling device is typically used to set the rifle scope orientation such that the elevation turret axis is plumb to the Earth when the anti-cant indicator is installed. This leveling device is typically placed against a flat reference surface of the rifle scope, such as a side of the turret housing or the end of a turret knob. Alternatively a carpenter's level is used to orient a vertical line drawn on a piece of paper such that the line is plumb. Then the vertical line is viewed through the rifle scope and the scope is rotated in the rings until the vertical line forming the crosshair is parallel to the plumb line. Alternatively, some rifle scope reticles have at least one long prominent horizontal line and only short vertical lines, one of which is prominent and forms the crosshair at the intersection of the prominent horizontal line. In this case, the scope is rotated until the horizontal line forming the crosshair is parallel to a horizontal line, typically printed or drawn on a piece of paper.

The leveling device must contain a spirit level comprised of a tubular bubble vial that is accurately aligned to a horizontal straight edge, and preferably have at least one vertical edge that is perpendicular to the horizontal edge. The tubular bubble vial is oriented with respect to the horizontal straight edge such that the bubble in the vial is centered between symmetric indicator marks when the straight edge is horizontal.

Leveling devices commonly available for leveling a rifle scope typically are mass-produced using injection molded parts that hold a tubular bubble vial securely in the device. This type of construction usually does not produce an accurate spirit level. When placed against a horizontal surface, devices of this type more often than not indicate that the horizontal surface is not level. Errors of greater than +/−1 degree are common in such devices. Usually a precision machined and assembled device is needed to align a surface horizontal to within +/−1 degree. Alternatively, machinist's levels have an adjustable tubular bubble vial that must be calibrated using a horizontal surface plate. Such leveling devices are expensive and heavy, and/or require expertise and special equipment to calibrate, and therefore are not well suited for use by sportsmen, competitors and recreational firearm enthusiasts.

A second aiming error may occur if the rifle scope has a horizontal offset from the rifle bore axis 90 (See FIG. 7A), such that the elevation turret axis 96 or vertical crosshair axis 98 does not pass through the center of the rifle bore. (See FIGS. 7 and 7A) In this case there is a horizontal component 105 to the angle subtended between the crosshair axis 94 and the rifle bore axis 90. This horizontal component It is the object of the present invention to provide a rifle scope vertical alignment device and method that is simple in construction, inexpensive to produce and contains no moving parts.

It is a further object of the present invention to provide a device and method that allows the rifle scope to be quickly, conveniently and accurately aligned such that the vertical reticle axis or elevation turret axis is projected through the center of the rifle bore and that includes double-sided adhesive tape in order to affix the device to the objective bell.

It is a further object of the present invention to provide an accurate spirit level that can be used to level or plumb a flat surface on the scope by first locating an edge of the device parallel to a flat surface on the rifle scope wherein said spirit level is visible from three sides.

It is a further object of the present invention to provide a device with a center of gravity that allows the device to stand inverted, resting on a flat, approximately horizontal surface.

It is a further object of the present invention to enable a method of manufacturing the device that provides a single machine for production of the substrate, and yet provides a durable reticle alignment device that includes an accurate spirit level and has square edges.

SUMMARY OF THE INVENTION

The basic embodiment of the present invention teaches an alignment tool comprising: a flat rectangular substrate said substrate having a first face, a second face, a first edge, a second edge, a third edge and a fourth edge; a v-groove notch shaped substantially in the center of said first edge wherein said v-groove has a vertex point and creates a triangular space thereby allowing for the positioning of said tool atop a curved surface; a plurality of lines printed on said first face of said substrate wherein a center axis exists along the center of said substrate in alignment with said vertex point of said v-groove extending to said second edge located parallel to said first edge and wherein said further 105 to the subtended angle leads to a windage aiming error at any target range other than the range used to zero the rifle. The magnitude of this aiming error increases proportionally to the difference between the zero range and target range. This aiming error can be eliminated by locating a reference line that passes through the center of the rifle bore and the center of the rifle scope objective.

This process can be performed using a device such as the one disclosed in U.S. Pat. No. 5,878,504 that has a tubular bubble vial, a v-notch located on one end and another v-notch located on a sliding stage attached thereto. The v-notches are placed against the rifle barrel and the rifle scope objective bell, thereby locating the reference line between the rifle bore axis and the objective lens axis. This alignment tool is machined from metal and has precisely translating mechanical parts which are expensive to manufacture. It is a specialized tool that weighs about 103 grams, is top-heavy and has a center of gravity location that causes it to tip over when placed on a small (approximately 0.5 inch diameter) horizontal surface, such as the top of a turret knob. Further, in the device of the '504 patent, due to its design, the view of the tubular bubble vial is unobstructed from two sides, but not from a third side (above) when the device is turned upside down and held against an approximately horizontal surface, thereby diminishing its utility. Therefore, it lacks versatility in design such that it can easily be used for other leveling purposes.

When using the '504 device, the rifle is then rotated so that the reference line is plumb to the Earth, and the rifle is temporarily held in this position. Finally, the rifle scope is rotated in the rings such that the vertical crosshair or turret axis is plumb.

Accordingly, a need exists for a simple, inexpensive and accurate leveling device that can be used by non-technical people to align a rifle scope to the bore of the rifle and set the vertical crosshair or turret axis plumb to the Earth.

plurality of lines are symmetrically located on both sides of said center axis; and a spirit level attached to said substrate.

The above embodiment can be further modified by defining that said spirit level is attached to said substrate near said second edge opposite said first edge containing said v-groove.

The above embodiment can be further modified by defining that said center axis is visible as a line printed or marked down the center of the substrate.

The above embodiment can be further modified by defining that the center of gravity of said substrate is displaced with respect to the center of the substrate.

The above embodiment can be further modified by defining that double-sided adhesive tape is attached to said substrate on the face opposite the face wherein said spirit level is located.

The above embodiment can be further modified by defining that said plurality of lines are substantially parallel.

The above embodiment can be further modified by defining that said plurality of lines are at least 1" long and no more than 7" long.

The above embodiment can be further modified by defining that said plurality of lines are no more than 3" long.

The above embodiment can be further modified by defining that said plurality of lines are at least 0.005" wide.

The above embodiment can be further modified by defining that said plurality of lines are 0.016-0.064" wide.

The above embodiment can be further modified by defining that said substrate is at least 2"×2.5" and not more than 6"×8".

The above embodiment can be further modified by defining that said substrate is no more than about 3.5"×4".

The above embodiment can be further modified by defining that the substrate is transparent.

The above embodiment can be further modified by defining that said spirit level is at least 0.2" wide and protrudes from said substrate no more than 1".

The above embodiment can be further modified by defining that said spirit level has a trapezoidal cross section.

The above embodiment can be further modified by defining that said trapezoidal cross section includes a top side located proximate to said second edge and is beveled so as to subtend at an angle between 80-99 degrees with respect to said substrate.

The above embodiment can be further modified by defining that said substrate balances vertically when said alignment tool substrate is oriented so that said second edge is used as a base and can support said tool on an approximately horizontal surface.

The above embodiment can be further modified by defining that the alignment tolerance of spirit level with regard to said center line is 90 degrees, +/−1 degree or less.

The above embodiment can be further modified by defining that said four edges of said substrate are square relative to each other.

A second embodiment teaches a method of providing an alignment tool comprising the steps of: obtaining said tool, said tool further comprising: a flat rectangular substrate said substrate having a first face, a second face, a first edge, a second edge, a third edge and a fourth edge; a v-groove notch shaped substantially in the center of said first edge wherein said v-groove has a vertex point and creates a triangular space thereby allowing for the positioning of said tool atop a curved surface; a plurality of lines printed on said first face of said substrate wherein a center axis exists along the center of said substrate in alignment with said vertex point of said v-groove extending to said second edge located parallel to said first edge and wherein said further plurality of lines are symmetrically located on both sides of said center axis; and a spirit level attached to said substrate positioning said v-groove on the barrel or hand guard of a rifle, adjacent to rifle scope objective; rotating said tool about the bore axis of said rifle to center objective with regard to said center axis; aligning said plurality of vertical lines with respect to the outer diameter of said rifle scope objective; pressing said tool onto said objective bell so that said double-sided adhesive tape attaches said tool to said objective rim; rotating said rifle about said bore axis to center said spirit level; securing said rifle in plumb position; inverting said tool and placing said spirit level end of said tool on the rifle scope turret cap; rotating said rifle scope about the ring axis to center said spirit level; and securing said rifle scope in plumb position.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 2:
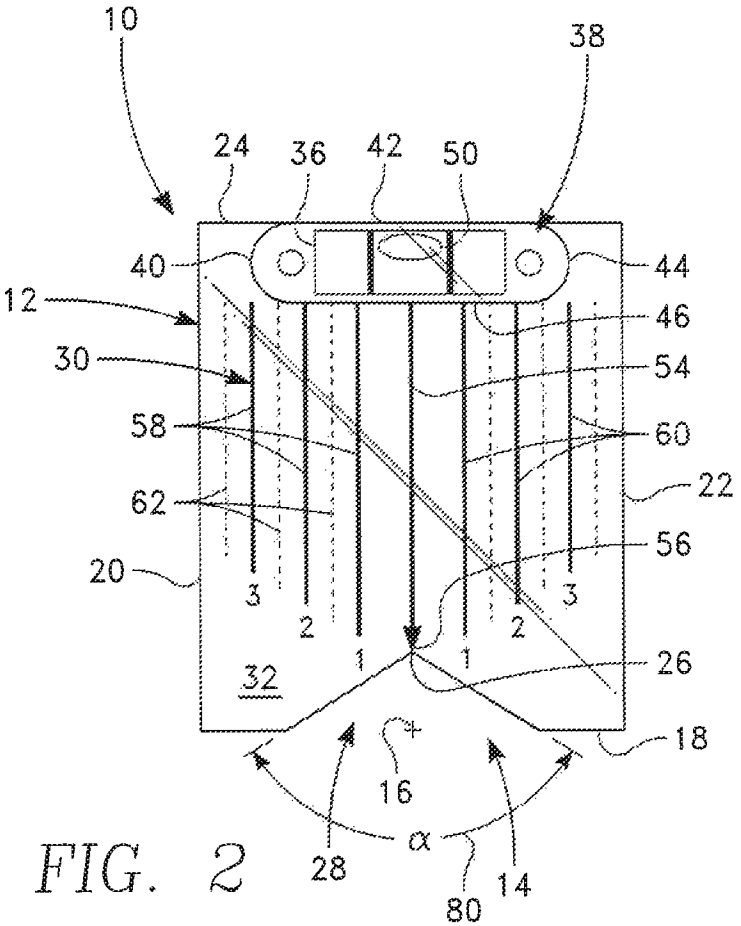
FIG. 2 is a front view of the first face of the device of the present invention.
Figure 1:
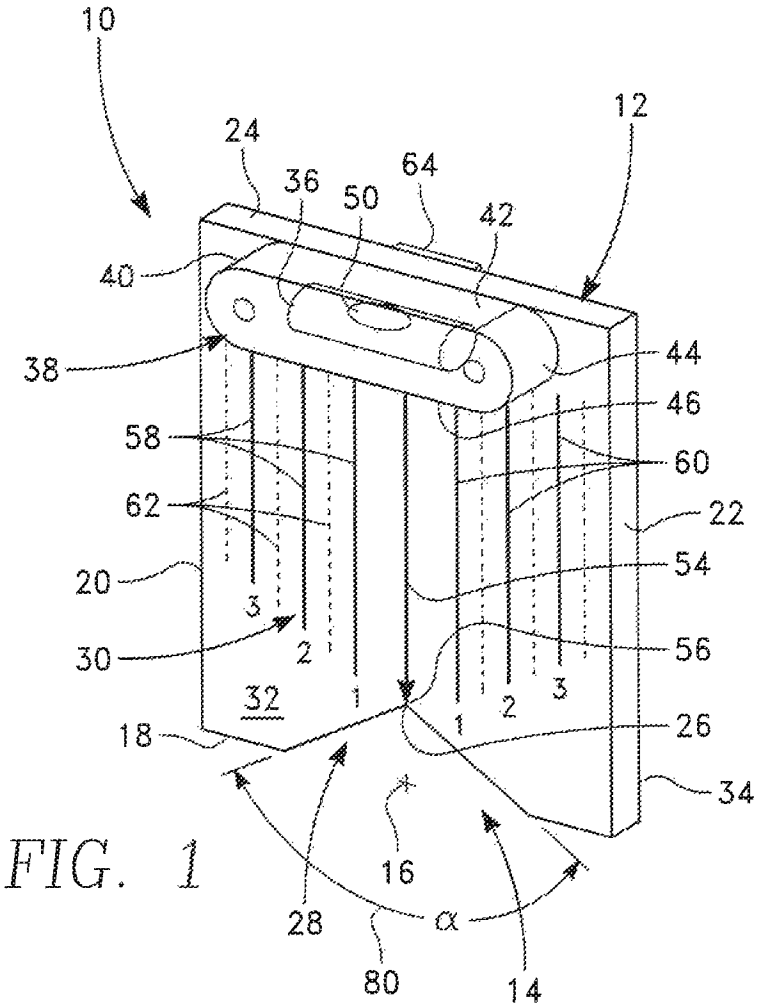
FIG. 1 is a perspective view of the first face of the device of the present invention.

Turning to the drawings, the preferred embodiment is illustrated and described by reference characters that denote similar elements throughout the several views of the instant invention.

The preferred embodiment is an alignment device 10 that includes a flat rectangular substrate 12 that has a v-notch 14 feature in the form of an isosceles triangle cut out of substantially the middle 16 of a first edge 18 of the substrate 12. The size of substrate should be at least 2"×2.5" and not more than 6"×8", and preferably no more than about 3.5"×4". At least two adjacent edges 18, 20, 22, 24 of the rectangular substrate 12 are square with respect to each other. Preferably all four edges 18, 20, 22, 24 of the rectangular substrate 12 are square with respect to adjacent edges.

In prior art methods and devices, manufacturing tolerances generally cause the spirit level to be inaccurate, such that the bubble is not precisely centered when the straight edge is horizontal. To eliminate canting errors the accuracy of the spirit level must be better than +/−1 degree, and preferably better than +/−30 arc minutes. Canting angles of less than +/−30 arc minutes create aiming errors that are typically less than the dispersion of the rifle at long range and therefore are considered to be insignificant. In the instant invention, it is preferred that the square adjacent edges 18, 20, 22, 24 subtend an angle of 90 degrees +/−1 degree, and more preferably to 90 degrees +/−30 arc minutes. The v-notch 14 is for locating the device 10 against the rifle barrel. The vertex angle 26 of the isosceles triangle 28 formed by the v-notch 14 and the first edge 18 of the substrate 12 is 90°-160°, and preferably 110°-140°. The width of the base of the isosceles triangle 28 is 0.75-4", and preferably 1-3". The substrate 12 may be made from any suitable material, but is preferably made from a transparent material, and more preferably from cast acrylic, polycarbonate, or other transparent, rigid polymer. The substrate 12 may be formed by any precision manufacturing method, such as laser cutting, scribe and break, sawing, machining, injection molding, or other suitable method.

The device 10 has a plurality of lines 30 printed on a first face 32 of the substrate 12. The device 10 also has a tubular bubble vial 36 mounted to substrate 12, and preferably to a second face 34 of the substrate 12 near a second edge 24 which is opposite the first edge 18. Preferably, the bubble vial 36 is held within a protective housing 38 that is permanently affixed to the substrate 12. The protective housing 38 is at least partially transparent such that the view of the bubble vial 36 is unobstructed from at least one side of the housing, and preferably from three sides of the housing. The long axis of the bubble vial 36 is parallel to the second edge 24. The housing 38 is preferably located approximately 2 mm or less proximate to the second edge 24. Preferably the top side 42 of the housing 38 located proximate to the second edge 24 of the substrate 12 is beveled, which aids the device 10 staying in place on the top of a turret knob 68 while the rifle 70 is being manipulated during the alignment process. More preferably the top side 42 subtends at an angle of 80-99 degrees with respect to the substrate 12 surface. The bubble vial 36 is aligned such that the bubble 50 is centered in the vial 36 when the second edge 24 is level. Preferably the bubble vial 36 is 0.1"−0.5" in diameter and the bubble vial housing 38 protrudes out 0.2"−1" from the substrate. Preferably the bubble level housing 38 is made from transparent acrylic material. The bubble level 36 may be attached to the substrate 12 by any suitable means, preferably by gluing or solvent bonding.

Figure 5:
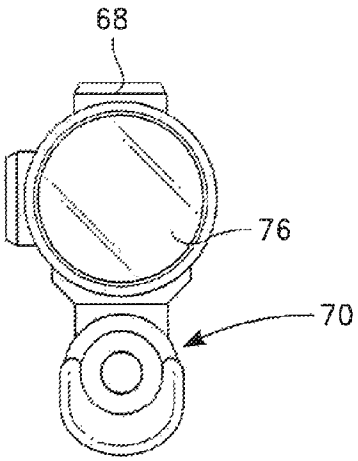
FIG. 5 is a front view of a rifle scope objective with the present invention attached thereto in a second position.
Figure 3:
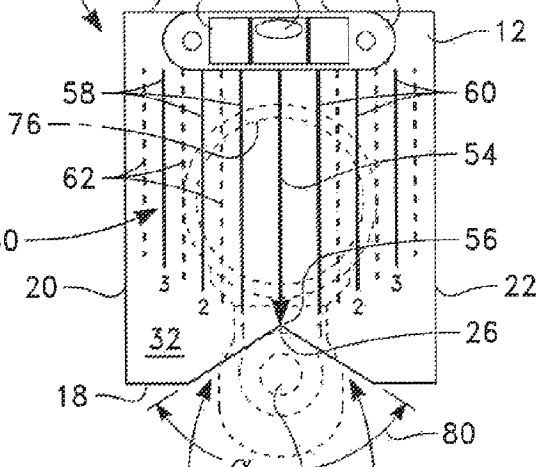
FIG. 3 is a front view of a rifle scope objective without the invention affixed thereto.
Figure 6:
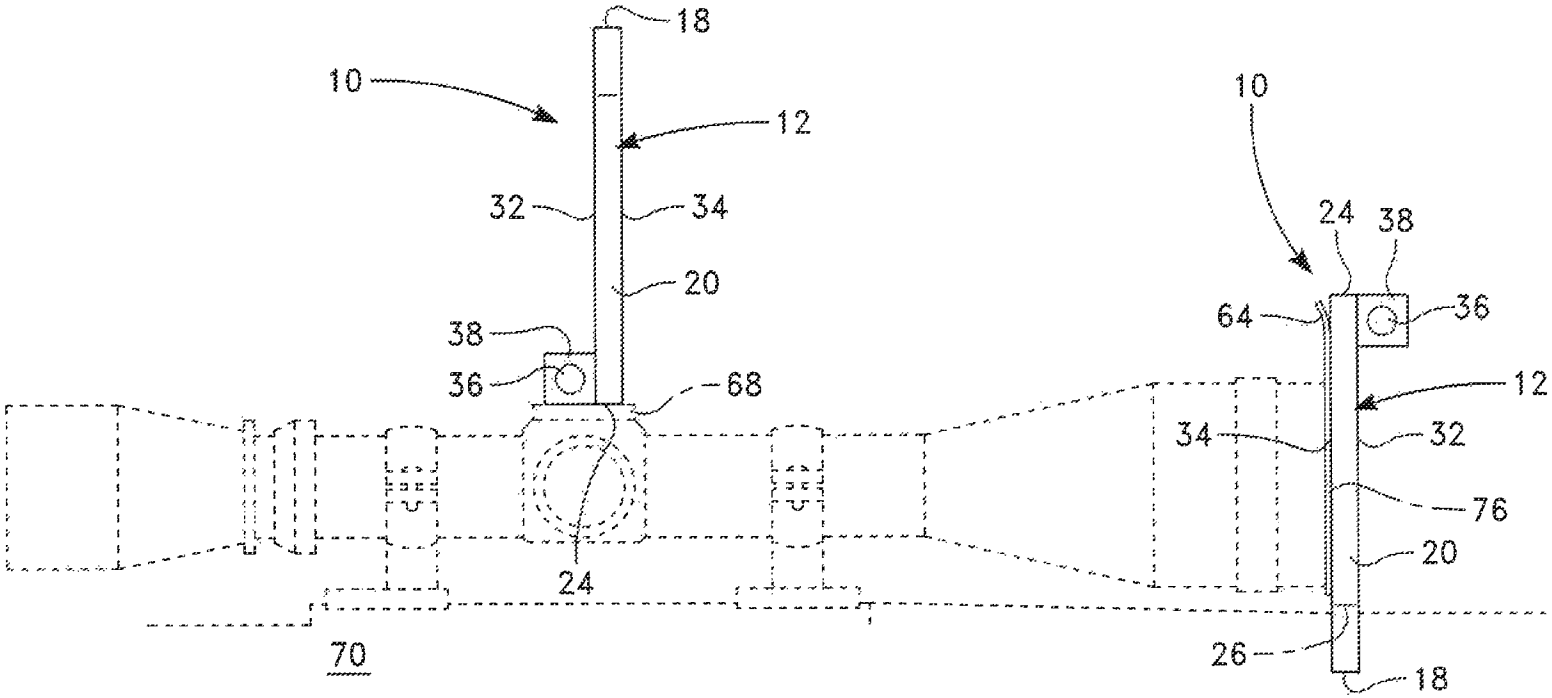
FIG. 6 is a side view of a rifle scope objective with the invention shown affixed thereto in both the first and second positions shown in FIGS. 4 and 5.
Figure 7:
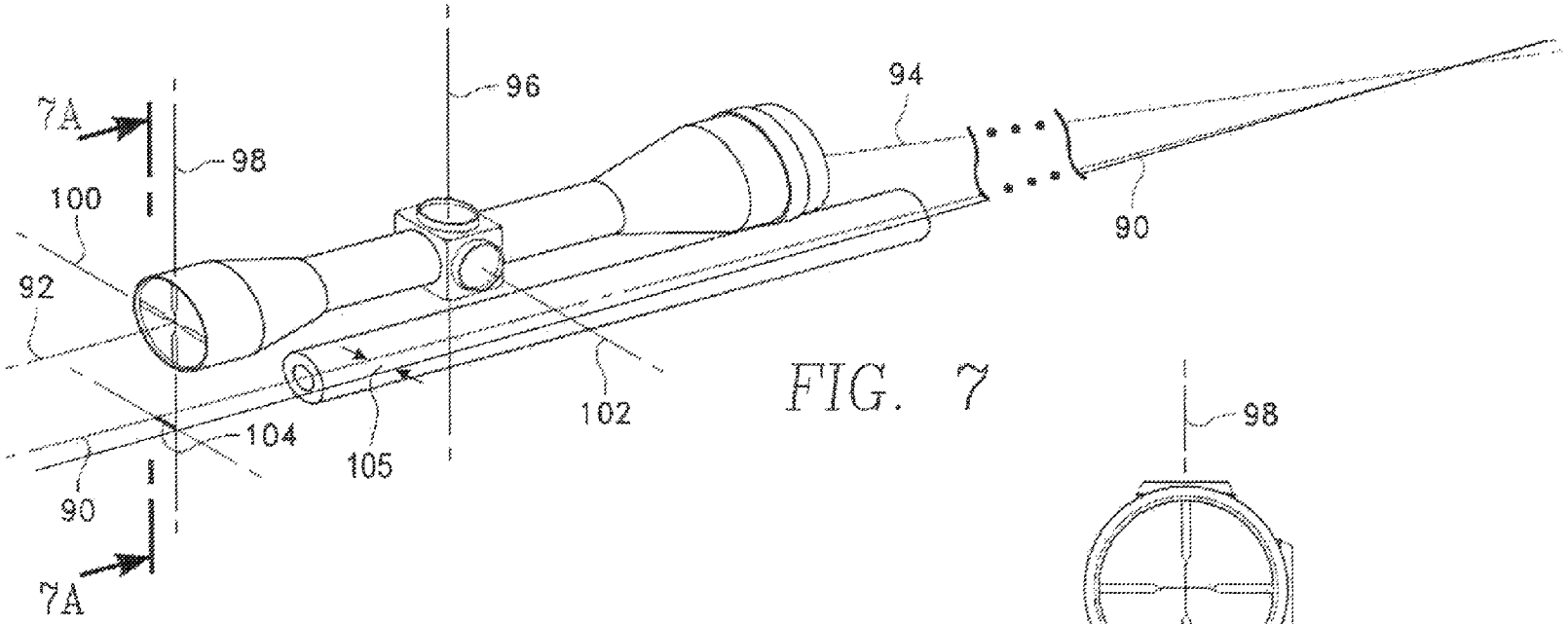
FIG. 7 illustrates the error produced by prior art methods, which the instant invention seeks to overcome.
Figure 7A:
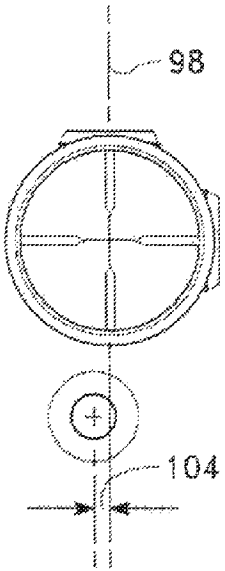
FIG. 7A is taken along line 7A-7A in FIG. 7.

The center of gravity of the device 10 is located between the tubular bubble vial 36 and substantially the middle of the substrate 12. The center of gravity of the device 10 is further located away from the center of the plane of the substrate 12, toward the face on which the bubble level housing 38 is attached. This location of the center of gravity enables the device 10 to remain upright without tipping over when the device 10 is inverted and allowed to freely stand with the second edge 24 proximate to the top of a turret knob 68 (See FIG. 5 and part of FIG. 6), or other approximately horizontal surface that is within about +/−10 degrees of horizontal. The location of the bubble level 36 proximate to the second edge 24 therefore serves the purpose of shifting the center of gravity toward the second face. Preferably, the bubble level housing 38 has a trapezoidal cross section, tipping the device 10 from being exactly vertical when it is inverted and allowed to freely stand on a horizontal surface. The trapezoidal cross section therefore shifts the center of gravity toward the center of the housing 38 when the device 10 is inverted and placed with the second edge 24 proximate to the top of a turret knob 38. Preferably the weight of the device 10 is less than about 50 grams, which provides a low momentum during handling and aids the device 10 staying in place on the top of a turret knob 68 while the rifle 70 is being manipulated during the alignment process. A magnet (not shown) may also be affixed to the substrate 12 about 3 mm or less proximate to the second edge 24. This magnet aids the device 10 staying in place on the top of a turret knob 68 while the rifle 70 is being manipulated during the alignment process.

A center axis line 54 may optionally be printed or marked down the center of the substrate 12 between the v-notch 14 and the bubble vial 36, and the end 56 of the axis 54 may be aligned to the vertex point 26 of the v-notch 14, such that the axis 54 bisects the vertex angle angle 80. If the axis 54 is printed or marked as a line, then it may be broken into multiple lines, such as solid, dashed, dotted, etc., arranged sequentially along the same axis. The center axis 54 is perpendicular to the second edge 24 to within +/−1 degree, and more preferably to within +/−30 arc minutes. When the v-notch 14 is located on the rifle barrel, the center axis 54 projects through the center of the bore of the barrel. A first plurality of lines 58 are printed or marked on one side of the center axis 54. A second plurality of lines 60 are printed or marked on the opposite side of the center axis 54, and arranged such that the second plurality of lines 60 is symmetric with respect to the first plurality of lines 58, the center axis 54 being in the center of the two plurality of lines 58, 60. When the device 10 is placed on the rifle 70, with the rifle barrel or hand guard located in the v-notch 14 and the substrate 12 is proximate to the rifle scope objective 76, the two pluralities of lines 58, 60 enable the rifle scope objective 76 to be visually centered with respect to the center axis 54.

The width of the lines within the first and second plurality of lines 58, 60 is at least 0.005" wide, and preferably 0.016-0.064" wide. Preferably, the total width across the substrate 12 of the first and second plurality of lines 58, 60, and the center axis 54, is between 1" and 4", and preferably no more than about 3". Preferably, the lines in the first and second plurality of lines 58, 60 are perpendicular to the first and second edges 18, 24. The length of the lines within the first and second plurality of lines 58, 60 is 1-7", and preferably no more than about 3". The lines may be printed or marked by any suitable means, such as offset printing, screen printing, laser printing, machining, etching, or any other suitable means. Preferably the lines are printed using a laser marking process, and the substrate 12 is cut using a laser cutting process, thereby producing a device 10 that has lines and edges that are generated on one machine and are therefore properly aligned with respect to each other.

A strip of double-sided adhesive tape 64 is located on a second face 34 of the substrate 12, aligned approximately parallel to the center axis 54. The adhesive tape 64 can span the distance between the vertex point 26 of the v-notch 14 and the second edge 24 of the substrate 12. The double sided tape 64 temporarily holds the substrate 12 against the objective bell of the rifle scope 76.

Figure 4:
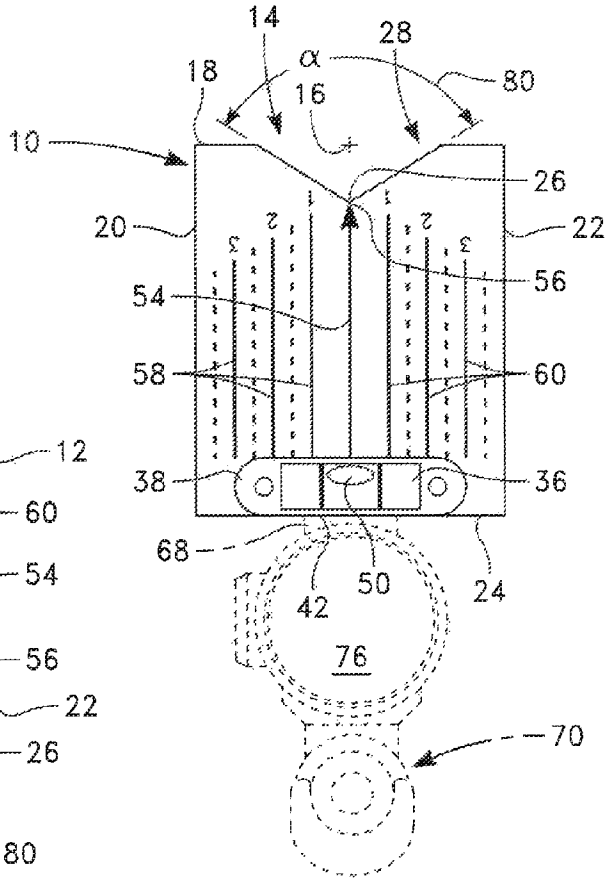
FIG. 4 is a front view of a rifle scope objective with the present invention attached thereto in a first position.

In use, the user locates the v-notch 14 on the barrel or hand guard of the rifle 70, proximate to rifle scope objective 76. The center axis 54 passes through the center of the barrel or hand guard. The device is then rotated about the rifle bore axis to center the rifle scope objective 76 with respect to the center axis 54 of the substrate 12. The plurality of lines 58, 60 are then aligned with respect to the outer diameter of the rifle scope objective 76 such that the center axis 54 passes through the center of the rifle scope objective 76. The device 10 is pressed onto the objective bell 76 so that double sided tape 64 affixes the substrate 12 to the objective rim of the rifle scope 76 (See FIGS. 4-6). The rifle is rotated about the bore axis to center the bubble 50 in the tubular bubble vial 36 and the rifle 70 is secured or held temporarily in this position. The device 10 is inverted and the substrate 12 is placed against a flat surface of the riflescope that is either parallel or perpendicular to either the vertical line forming the crosshair or the elevation turret axis. The rifle scope is rotated about the mounting ring axis to center the bubble 50 in the tubular bubble vial 36, and the rifle scope secured in the rings with the rifle scope and device 10 in the horizontal position.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. An alignment tool comprising:

a flat rectangular substrate said substrate having a first face, a second face, a first edge, a second edge, a third edge and a fourth edge;

a single v-groove notch shaped substantially in the center of said first edge wherein said v-groove has a vertex point and creates a triangular space thereby allowing for the positioning of said tool atop a curved surface;

a plurality of vertical lines printed on said first face of said substrate wherein a center axis exists along the center of said substrate in alignment with said vertex point of said v-groove extending to said second edge located parallel to said first edge and wherein said further plurality of lines are symmetrically located on both sides of said center axis wherein said vertical lines provide alignment of a rifle scope objective; and a spirit level attached to said substrate.

2. The alignment tool as defined in claim 1 wherein said spirit level is attached to said substrate near said second edge opposite said first edge containing said v-groove.

3. The alignment tool as defined in claim 1 wherein said center axis is visible as a line printed or marked down the center of the substrate.

4. The alignment tool as defined in claim 1 wherein the center of gravity of said substrate is displaced with respect to the center of the substrate toward said second surface of said substrate.

5. The alignment tool as defined in claim 1 wherein double-sided adhesive tape is attached to said substrate on the face opposite the face wherein said spirit level is located.

6. The alignment tool as defined in claim 1 wherein said plurality of lines are substantially parallel.

7. The alignment tool as defined in claim 1 wherein said plurality of lines are at least 1" long and no more than 7" long.

8. The alignment tool as defined in claim 7 where said plurality of lines are no more than 3" long.

9. The alignment tool as defined in claim 1 wherein said plurality of lines are at least 0.005" wide.

10. The alignment tool as defined in claim 9 wherein said plurality of lines are 0.016-0.064" wide.

11. The alignment tool as defined in claim 1 wherein said substrate is at least 2"×2.5" and not more than 6"×8".

12. The alignment tool as defined in claim 11 wherein said substrate is no more than 3.5"×4".

13. The alignment tool as defined in claim 1 wherein the substrate is transparent.

14. The alignment tool as defined in claim 1 wherein said spirit level is at least 0.2" wide and protrudes from said substrate between 0.2"- 1".

15. An alignment tool comprising:

a flat rectangular substrate said substrate having a first face, a second face, a first edge, a second edge, a third edge and a fourth edge;

a v-groove notch shaped substantially in the center of said first edge wherein said v-groove has a vertex point and creates a triangular space thereby allowing for the positioning of said tool atop a curved surface;

a plurality of lines printed on said first face of said substrate wherein a center axis exists along the center of said substrate in alignment with said vertex point of said v-groove extending to said second edge located parallel to said first edge and wherein said further plurality of lines are symmetrically located on both sides of said center axis; and a spirit level attached to said substrate wherein said spirit level has a trapezoidal cross section and wherein said trapezoidal cross section includes a top side located proximate to said second edge and is beveled so as to subtend at an angle between 80-99 degrees with respect to said substrate.

16. The alignment tool as defined in claim 1 wherein said substrate balances vertically when said alignment tool substrate is oriented so that said second edge is used as a base and can support said tool on an approximately horizontal surface.

17. The alignment tool as defined in claim 1 wherein the alignment tolerance of spirit level with regard to said center line is 90 degrees, +/−1 degree or less.

18. The alignment tool as defined in claim 1 wherein said four edges of said substrate are square relative to each other.

19. A method of providing and using an alignment tool comprising the steps of:

obtaining said tool, said tool further comprising:

a flat rectangular substrate said substrate having a first face, a second face, a first edge, a second edge, a third edge and a fourth edge;

a v-groove notch shaped substantially in the center of said first edge wherein said v-groove has a vertex point and creates a triangular space thereby allowing for the positioning of said tool atop a curved surface;

a plurality of lines printed on said first face of said substrate wherein a center axis exists along the center of said substrate in alignment with said vertex point of said v-groove extending to said second edge located parallel to said first edge and wherein said further plurality of lines are symmetrically located on both sides of said center axis;

a spirit level attached to said substrate; and double-sided adhesive tape attached to said substrate on the face opposite the face wherein said spirit level is located;

obtaining a rifle, said rifle further comprising a barrel, a hand guard, a bore axis, a rifle scope with an objective, objective bell, and an objective rim;

positioning said v-groove on the barrel or hand guard of a rifle, adjacent to the rifle scope objective;

rotating said tool about the bore axis of said rifle to center objective with regard to said center axis;

aligning said plurality of vertical lines with respect to the outer diameter of said rifle scope objective;

pressing said tool onto said objective bell so that said double-sided adhesive tape attaches said tool to said objective rim;

rotating said rifle about said bore axis to center said spirit level;

securing said rifle in plumb position;

inverting said tool and placing said spirit level end of said tool on a rifle scope turret cap;

rotating said rifle scope about a ring axis to center said spirit level; and securing said rifle scope in plumb position.

* * * * *